US009387908B1

(12) United States Patent
Paulino

(10) Patent No.: US 9,387,908 B1
(45) Date of Patent: Jul. 12, 2016

(54) BOAT HULL

(71) Applicant: Jesus E Paulino, Cleveland, OH (US)

(72) Inventor: Jesus E Paulino, Cleveland, OH (US)

(73) Assignee: Jesus E. Paulino, Cleveland, OH (US)

( * ) Notice: Subject to any disclaimer, the term of this patent is extended or adjusted under 35 U.S.C. 154(b) by 0 days.

(21) Appl. No.: 14/544,478

(22) Filed: Jan. 12, 2015

(51) Int. Cl.
*B63B 1/04* (2006.01)
*B63B 1/34* (2006.01)

(52) U.S. Cl.
CPC .. *B63B 1/042* (2013.01); *B63B 1/34* (2013.01)

(58) Field of Classification Search
CPC ..... B63B 1/042
USPC ..... 114/290
See application file for complete search history.

(56) References Cited

U.S. PATENT DOCUMENTS 3,148,652 A * 9/1964 Canazzi ..... B63B 1/20 114/290
4,091,761 A * 5/1978 Fehn ..... B63B 1/20 114/271
4,989,534 A * 2/1991 Field ..... B63B 1/18 114/289
5,351,642 A * 10/1994 Ackerbloom ..... B63B 1/04 114/291
5,427,048 A * 6/1995 Takeuchi ..... B63B 1/16 114/288
5,435,260 A * 7/1995 Granie ..... B63B 1/12 114/290
5,645,003 A * 7/1997 Grinde ..... B63B 1/042 114/125
6,216,622 B1 * 4/2001 Lindstrom ..... B63B 1/042 114/288
6,708,642 B1 * 3/2004 Taylor ..... B63B 1/042 114/290
7,240,632 B1 * 7/2007 Wynne ..... B63B 1/20 114/140
8,065,970 B2 * 11/2011 Sorrentino ..... B63B 1/12 114/290

* cited by examiner

*Primary Examiner* — Lars A Olson
*Assistant Examiner* — Jovon Hayes
(74) *Attorney, Agent, or Firm* — Mark E. Bandy; Rankin, Hill & Clark LLP

(57) ABSTRACT

A boat hull having elongated concave tunnels is described. The elongated concave tunnels reduce the amount of drag and water friction with the boat hull in contact with water. A faster plane mode, better speed, stability, and fuel efficiency are achieved. Air is forced through the elongated concave tunnels during planing, thus producing lift and results in the boat achieving the plane mode faster. At cruising speeds and high speeds, more lift is generated by faster air passing through the elongated concave tunnels thus giving generous lift to the boat hull and hence producing minimal friction and drag in contact between the boat hull and the water surface.

3 Claims, 3 Drawing Sheets

*Back view of boat*

BOAT HULL

RELATED APPLICATIONS

The present application is a continuation-in-part application of U.S. provisional patent application Ser. No. 62/095,064, filed Dec. 22, 2014, for BOAT HULL, by JESUS E PAULINO, included by reference herein and for which benefit of the priority date is hereby claimed.

FIELD OF THE INVENTION

The present invention relates to a boat hull and more particularly, to a boat hull with elongated concave tunnels that produces less friction and drag between the boat hull and water surface during planning, cruising, and high speeds.

BACKGROUND OF THE INVENTION

Boat designs that provide a boat hull with a central tunnel commonly called tunnel hull boats or trimaran hulls have the excessive tendency to raise the bow of the boat too much at high speeds specially with head winds. A more pleasant effect is to obtain a rise on the stern so the angle of inclination at high speeds is not excessive. Tunnel and trimaran hull type boats have a tendency to rise excessively on head winds. The feature of the elongated concave tunnels 10, 12 is to redirect and force air to pass through those elongated concave tunnels 10, 12 towards stern 16 to produce the right amount of lift to raise the boat hull 18 and thus producing minimal boat hull 18 contact with water and producing less drag and friction. The bow on this boat hull design doesn't have the excessive opennings like that of a tunnel or trimaran hull boats. Excessive lift is not produced at the bow specially on head winds and air is redirected to those elongated concave tunnels 10, 12 towards the stern 16 giving the right amount of lift to the boat hull 18 thus minimizing the amount of boat hull 18 contact with water. The design of the elongated concave tunnels 10, 12 will result in faster planning time and will also help attain faster speeds and stability with less power needed making the boat more fuel efficient. Other boat designs have incorporated channels inside the hull that extend from the bow to the stern. It does give the boat stability when stationary or on plane mode cause of water filling and passing though those channels, but falls short on achieving faster planning times cause of the drag and friction that is being generated by water flowing through those channels, and on cruising and high speeds those boat hulls have the same characteristics of other boat hull designs due to the fact that friction and drag between the boat hull and water surface is not minimized. The advantages of having the embodiment of elongated concave tunnels under the boat hull is that less boat hull is in contact with water during planning, cruising, and high speed, air is redirected to those elongated concave tunnels to produce lift so less drag and friction between the boat hull and water surface is achieved.

| Prior art | | |
|---|---|---|
| 4,091,761 | May 30, 1978 | Fehn |
| 5,645,003 | Jul. 8, 1997 | Grinde |
| 6,216,622 | Apr. 17, 2001 | Lindstrom/Kirkham |
| 8,065,970 | Nov. 29, 2011 | Sorrentino |

Boat designers have tried different types of boat hull designs in an attempt to have the least amount of water in contact with the boat hull surface while on planning, cruising, or at high speeds. Others have come close to it but had problems on excessive bow lift on high speeds, others have tried to solve the problem but fell short due to having too much drag or friction between the boat hull and water surface in trying to control the excessive lift generated by the bow. The embodiment of the elongated concave tunnels 10, 12 eliminated the excessive lift produced to the bow by redirecting the air through the elongated concave tunnels 10, 12 to produce the right amount of lift for both bow and stern 16 thus producing minimal boat hull 18 contact with the water surface.

SUMMARY OF THE INVENTION

In accordance with the present invention, the embodiment of the elongated concave tunnels 10, 12 reduces the amount of drag and friction on the boat hull 18 in contact with water. Air passes through the elongated concave tunnels 10, 12 during planning, thus producing lift and gets the boat on the plane mode faster. On cruising and high speeds, more lift is produced by faster air passing through those elongated concave tunnels 10, 12 thus giving lift to the hull and minimizing drag and friction in contact with the water surface.

The purpose of the elongated concave tunnels is to minimize boat hull contact with water while on planning mode, cruising, and high speeds. Water contact with upper part of the elongated concave tunnels is eliminated since air is passing through those elongated concave tunnels 10, 12 thus less water contact with the boat hull. Lift and less drag and friction with the boat hull and water surface is obtained It is also a further advantage that since less drag and friction is produced, faster planning mode, faster speeds with less power needed are attained, hence better fuel efficiency is achieved in the process.

BRIEF DESCRIPTION OF THE DRAWINGS

A complete understanding of the present invention may be obtained by reference to the accompanying drawings, when considered in conjunction with the subsequent, detailed description, in which:

figures 10, 12 are the elongated concave tunnels. figure 14 shows the outline view of the elongated concave tunnels and how it shallows and tapers to a point towards the bow. figure 16 is the stern of the boat;

figures 12 are the shorter of the elongated concave tunnels. figures 10 are the longer of the elongated concave tunnels; figures 12 are the shorter elongated concave tunnels. figures 10 are the longer of the elongated concave tunnels.

For purposes of clarity and brevity, like elements and components will bear the same designations and numbering throughout the Figures.

DESCRIPTION OF THE PREFERRED EMBODIMENT

Figure 1:
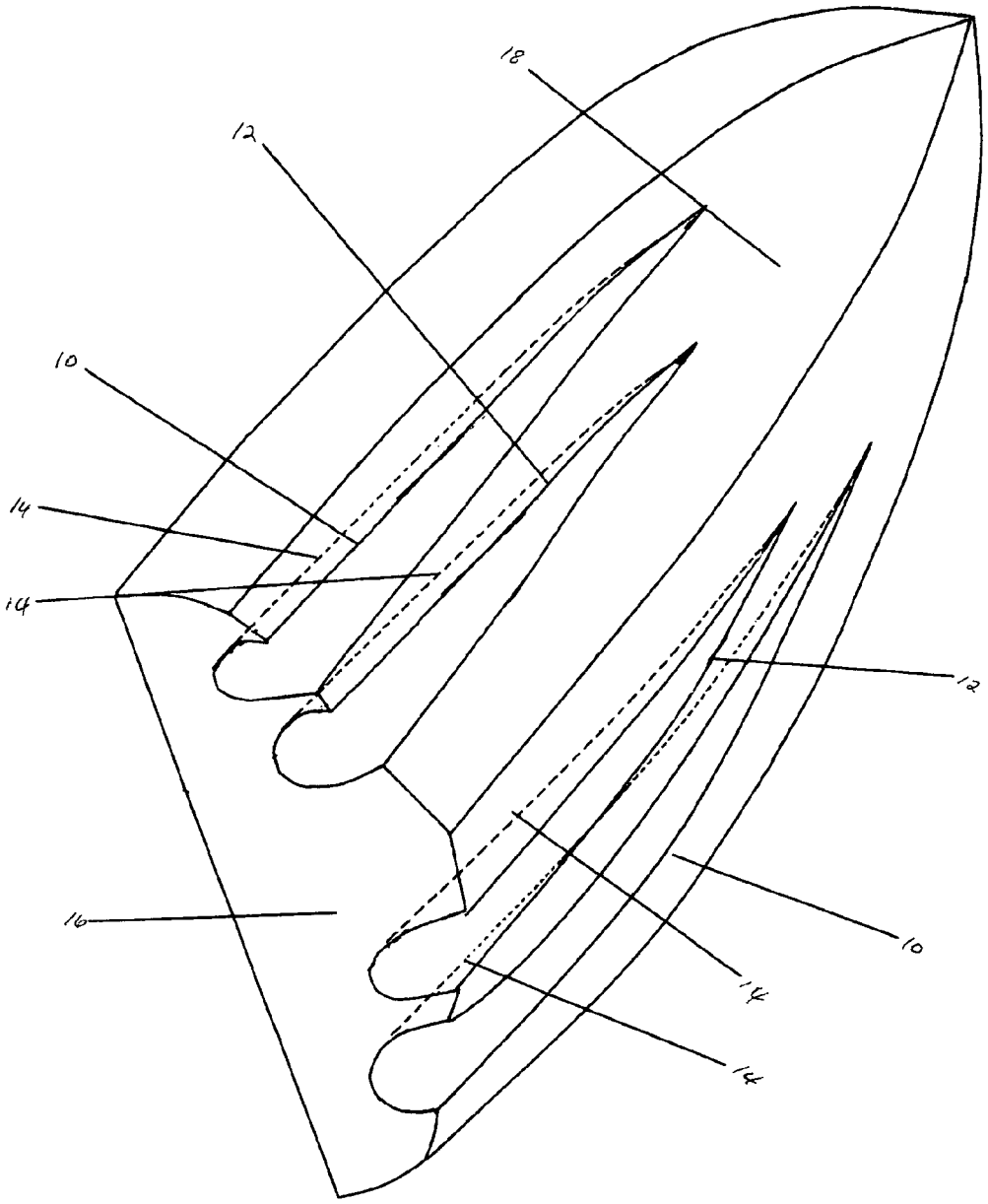
FIG. 1 is an angle view of a boat hull 8.

FIG. 1 is an angle view of the boat hull 18 with elongated concave tunnels 10, 12. Figures 10 are the longer elongated concave tunnels 10 and also shows the location under the boat hull 18. Figures 12 are the shorter of the elongated concave tunnels and also shows the location under the boat hull 18. Both figures 10, 12 are located on either side of the bottom of the boat hull 18 and that figures 10 the longer of the elongated concave tunnels extends to but not limited to about ¾ of the length of the boat hull 18 while figures 12 the shorter of the elongated concave tunnels extends to but not limited to ½ the length of the boat hull 18. Elongated concave tunnels 10, 12 can be applied to variety of different types of boat hulls 18 e.g. flat hulls, V hulls etc. The effectiveness of this type of elongated concave tunnels 10, 12 is that less boat hull 18 is in contact with the water surface during planning, cruising and high speed, since is air is redirected to those elongated concave tunnels 10, 12 lift is being produced through the process, enabling minimal hull contact with the water surface. Figures 14 shows the outlined view of the elongated concave tunnels 10, 12 and how it shallows and tapers to a point towards the bow of the boat. Before planning the elongated concave tunnels 10, 12 are submerged in water and while slowly speeding up or entering into plane mode water and air is pushed through those elongated concave tunnels 10, 12 and while building up speed more air is forced through those elongated concave tunnels 10, 12 forcing lift to the boat hull 18 to produce less drag friction with the water surface thus getting the boat on a faster plane mode. While on cruising and high speeds more and faster air is forced through those elongated concave tunnels 10, 12 creating more lift thus making the boat hull 18 have minimal contact with the water surface. Since the hull is not of a tunnel or trimaran hull construction excessive air passing through the bow is not produce specially on head winds. The embodiment of the elongated concave tunnels 10, 12 gives the boat better stability and excellent lift without having excessive lift to the bow of the boat. Faster planning time and faster speeds with less power needed are achieved and fuel efficiency are attained due to minimal friction and drag between the boat hull 18 and the water surface.

Figure 2:
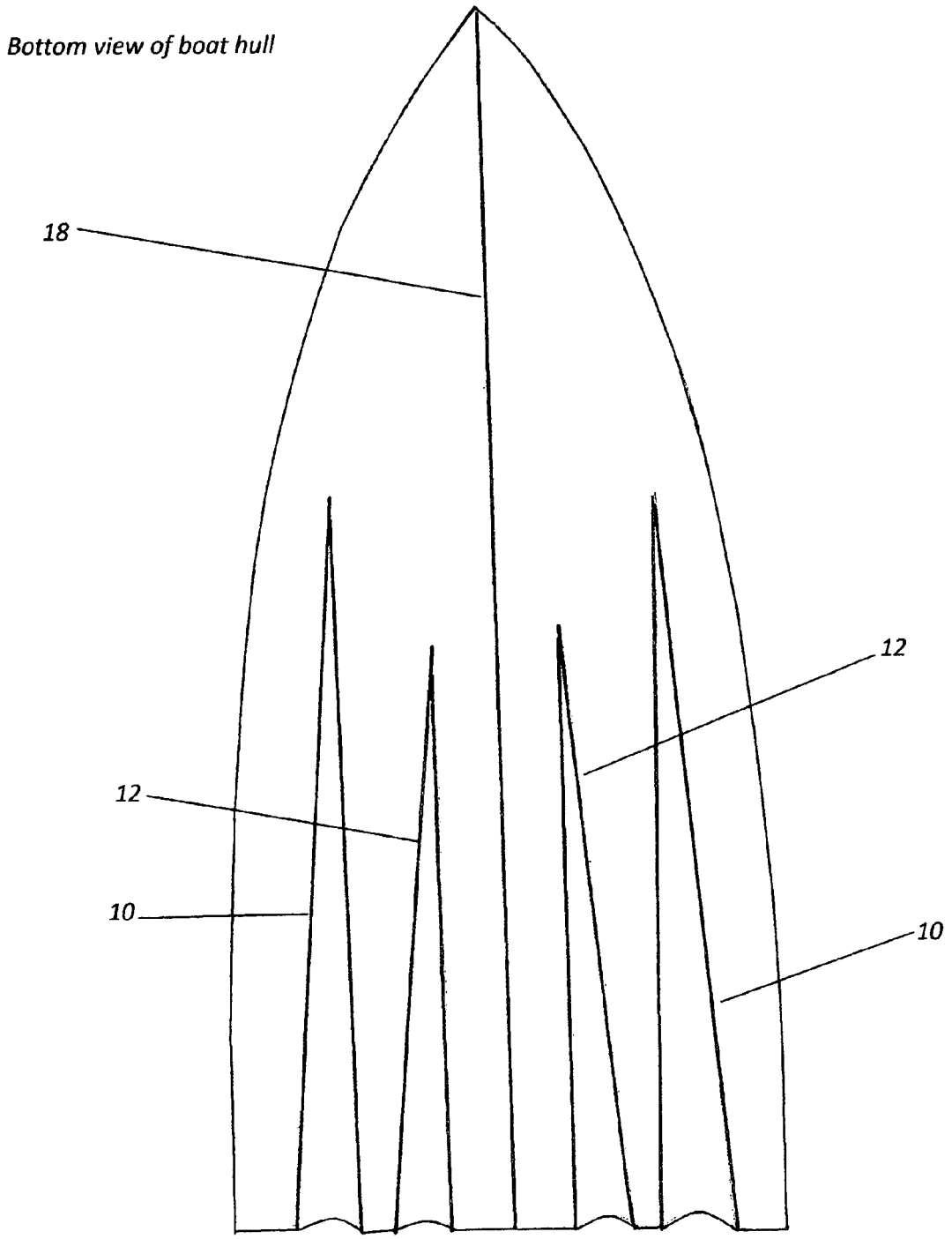
FIG. 2 is a bottom view of the hull of the boat 18.

FIG. 2 is a bottom view of the boat hull 18 with elongated concave tunnels 10, 12 and a good view where the elongated concave tunnels 10, 12 are located on the bottom of the boat hull 18. It clearly shows where figures 10 the longer of the elongated concave tunnels are located and where figures 12 the shorter of the elongated concave tunnels are located under the boat hull 18.

Figure 3:
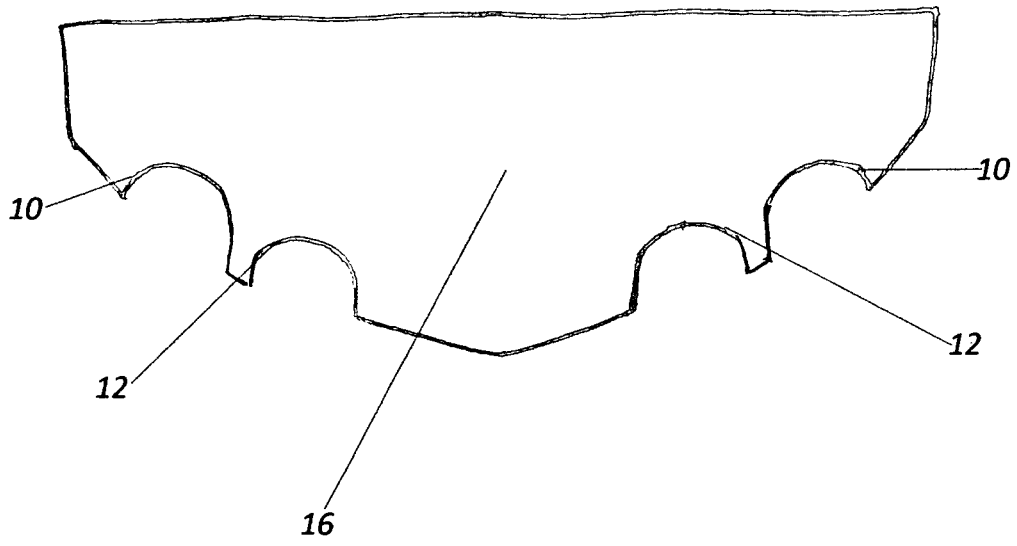
FIG. 3 is a stern view of the boat.

FIG. 3 is a stern 16 view of the boat hull 18 with elongated concave tunnels 10,12. Figures 12 are the longer of the elongated concave tunnels and figures 10 are the shorter of the elongated concave tunnels. Figure 16 is the stern of the boat and the view of the elongated concave tunnels 10 and 12.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A boat hull defining a stern, a bow, and an underside extending between the stern and bow, the boat hull further defining a first pair of elongated concave tunnels extending from the stern toward the bow and a second pair of elongated concave tunnels extending from the stern toward the bow, each of the elongated concave tunnels of the first pair of elongated concave tunnels being located closer to an outer periphery of the boat hull as compared to a respective elongated concave tunnel of the second pair of elongated concave tunnels wherein the length of the first pair of elongated concave tunnels is greater than the length of the second pair of elongated concave tunnels.

2. The boat hull of claim 1 wherein the length of the first pair of elongated concave tunnels is ¾ of the length of the boat hull.

3. The boat hull of claim 1 wherein the length of the second pair of elongated concave tunnels is ½ of the length of the boat hull.

* * * * *